United States Patent [19]

Potapov et al.

[11] 4,184,352

[45] Jan. 22, 1980

[54] METHOD FOR PILGER ROLLING OF TUBES AND MILL FOR EFFECTING SAME

[75] Inventors: Ivan N. Potapov; Petr I. Polukhin; Ivan P. Gremyakov, all of Moscow; Mikhail A. Bitny, Alma-Ata; Anatoly G. Vinogradov, Pervouralsk Sverdlovskoi; German D. Styrkin, Noginsk, Moskovskoi; Gennady V. Filimonov, Moscow; Vladimir M. Kolesov, Alma-Ata; Igor M. Raushenbakh, Alma-Ata; Vasily P. Pedas, Alma-Ata; Alexandr V. Ukhov, Alma-Ata; Petr A. Rodionov, Alma-Ata, all of U.S.S.R.

[73] Assignee: Moskovsky Institut Stali i Splavov, Moscow, U.S.S.R.

[21] Appl. No.: 913,810

[22] Filed: Jun. 8, 1978

[51] Int. Cl.[2] ..... B21B 21/00

[52] U.S. Cl. ..... 72/208; 72/214; 72/252

[58] Field of Search ..... 72/193, 189, 208, 209, 72/214, 252

[56] References Cited

U.S. PATENT DOCUMENTS

| | | | |
|---|---|---|---|
| 2,005,657 | 6/1935 | Ludwig | 72/252 |
| 2,680,391 | 6/1954 | Kaiser | 72/189 |
| 3,487,675 | 1/1970 | Edstrom et al. | 72/370 |

*Primary Examiner*—Milton S. Mehr

*Attorney, Agent, or Firm*—Lackenbach, Lilling & Siegel

[57] ABSTRACT

In the process of rolling a tubular billet with a mandrel is displaced in the rolling direction as it is simultaneously rotated about its longitudinal axis. Then a portion of the billet is advanced between the working rolls and is drawn over the mandrel during backward movement of the billet together with the mandrel. During forward movement of the billet with the mandrel, the billet is displaced relative to the mandrel in the same direction for a distance equal to that covered by the billet portion fed into the gap between the working rolls. The backward movement of the billet with the mandrel is effected at a speed substantially close to the peripheral speed of the working rolls at the starting moment of the drafting operation. The pilger mill comprises a stationary stand with continuously rotating working rolls. The mill also incorporates a billet feeding and turning mechanism and a billet gripping jaw kinematically linked with each other. The billet gripping jaw has screw nuts coaxially positioned therein and cooperating with a lead screw mounted together with the mandrel rod in a carriage. A tube turning mechanim has a tube gripping means accommodated in its body. Feeding and turning shafts in the billet feeding and turning mechanism are made hollow and formed with openings to receive respectively the lead screw and mandrel rod coaxially arranged therein.

3 Claims, 12 Drawing Figures

METHOD FOR PILGER ROLLING OF TUBES AND MILL FOR EFFECTING SAME

BACKGROUND OF THE INVENTION

I. Field of the Invention

The present invention relates to the production of tubes and, more particularly, to a method of, and a mill for, pilger rolling of tubes.

In modern practice cold rolling of tubes is carried out mainly on rolling mills equipped with movable stands. There is a tendency to constructionally improve mills for cold rolling of tubes by increasing the area of deformation, employing rolls which are smaller in size, increasing the operating speed of such rolls, making use of the multi-strand and so-called warm rolling, and improving the sizing tool and the procedure for preheating an initial tubular billet to be rolled.

An increase in the number of passes effected by a roll mill stand is possible to achieve by reducing the weight of such stand and by balancing the masses which perform reciprocated motion. It should be observed, however, that the reduction in weight of the working stand results in lower rigidity of the system comprised of a roll, ball bearing, chock and roll housing, thereby adversely affecting the dimensional accuracy of the tubes, as well as the quality of their surfaces.

Moreover, the reduced weight of the working stand fails to have any appreciable effect on the production capacity of the rolling mills, since the insufficient rigidity of such working stands makes it necessary to lower the rolling force.

II. Description of the Prior Art

A certain increase in the number of double passes of a working stand has been achieved by using various types of balance arrangements, for example, pneumatic, counterweight and spring balance arrangements. The application of such arrangements for balancing movable masses renders the rolling mill more complicated in construction and larger in size, and imposes more stringent requirements on the manufacturing accuracy and mounting technique of the fast-operating units of the rolling mill.

To enhance the production efficiency of the mills for cold rolling of tubes, such mills have been equipped with roll mill stands adapted for double-strand rolling. These stands are heavy in weight and, therefore, are capable of performing but a limited number of passes, since they require a bulky balance arrangement for their most effective operation.

Rolling mills for cold rolling of tubes effected by means of rollers have found wide application in the production of cold-rolled tubes having superthin walls. In these mills, as distinct from the mills where cold rolling of tubes is effected by means of rolls, the drawing of a tube is performed over a cylindrical mandrel by means of rollers forming a pass of constant radius equal to the radius of the finished tube.

When rolling is effected by means of rollers, the travelling distance of the working stand extends for a length of 1.8 to 2.0 times the rotating length of the roller, i.e. for a length greater than that of the tube section being rolled. This, in turn, results in an appreciable dynamic force transmitted to a drive means. The total drawing of tubes on cold rolling mills effected by means of rollers rarely achieves triple value, since the tube wall is reduced mainly in thickness and partially in diameter.

It has been found in the course of operation of the rolling mills furnished with rollers that an increase in the rate of feeding, as well as in total deformation effected in a single pass, results in a lower quality of the tube surface and in an impaired accuracy of their geometrical dimensions, which is manifested in the imperfect roundness and nonuniform thickness of the tube wall.

It has been found that the quality of the surface and the dimensional accuracy of the tubes cold-rolled at the tube-rolling mills are improved as the rigidity of the working stands and rolls thereof is increased, and the production efficiency of such mills is enhanced as the weight of the mill reciprocatingly moving parts is lowered. The reduction in weight of the mobile stand, however, results in its lower rigidity, which, in turn, makes it impossible to ensure improved drawing and higher accuracy of the tube dimensions. British Pat. No. 1,149,822 describes a rolling mill for intermittent cold rolling of tubes effected by means of undriven rolls. This rolling mill comprises a stationary mounted working stand which accommodates two rolls. The mandrel rod in the working stand is rigidly connected with a gripping jaw, the gripping jaw being connected by means of a spring to a carriage. The carriage driving mechanism in this rolling mill is made in the form of a barrel cam fitted with a loop-like groove. Received in said groove is a lug rigidly fixed on the carriage body. The mandrel used is cylindrical in shape. A tubular billet is fed by means of a lead screw which interacts with the housing of the carriage driving mechanism, having the barrel fixed therein. During the feeding operation the body of said driving mechanism is moved towards the working stand. The same lead screw is used to withdraw the rod.

The rolling mill of the British patent referred to above is unsuitable for rolling of tubes to be reduced 1.5 to 3 times in inside diameter. In this case it will be necessary to replace the barrel when resetting the mill. Furthermore, the tube feeding mechanism should be moved together with the billet being fed, which adds to dynamic loads acting on the drive means. Since the mill in question is not provided with a mechanism for turning the finished tube, it is impossible to use one mandrel for rolling two tubes, since the finished tube is not fixed in the jaw and interacts only with the working rolls, the mandrel and with the incoming billet.

OBJECTS OF THE INVENTION

An object of the present invention is to provide a method of pilger rolling of tubes to be performed in accordance with certain operating conditions that will permit rolling of tubes from hard-to-deform metals and alloys, such as zirconium, molybdenum, titanium, niobium, etc., by applying advanced technological processes. Also provided is a pilger mill for rolling tubes in which a mechanism for feeding and turning a billet, a mechanism adapted to transmit reciprocated motion to a carriage, and a tube turning mechanism are kinematically interlinked so as to permit the method of the invention to be carried into effect.

Another object of the invention is to reduce the dynamic loads acting in the gearing system of a drive means by reducing the weight of bulky parts performing reciprocated motion.

Still another object of the invention is to improve the quality and dimensional accuracy of the tubes being rolled.

Yet another object of the invention is to provide a method of pilger rolling of tubes, effected in accordance with certain operating conditions and on, a mill, intended for performing the method of the invention and provided with a gearing system, that will permit rapid and effective installation and resetting of a pilger mill.

SUMMARY OF THE INVENTION

These and other objects of the invention are accomplished by a method of pilger rolling of tubes effected in a stationary roll mill stand with continuously rotating working rolls forming a pass, the working section of which is curvilinear in profile. A tubular billet and a mandrel are displaced forward in the rolling direction while they are simultaneously rotated about a longitudinal axis. A portion of the billet is advanced between the rolls, and during backward movement of the billet together with the mandrel this portion of the billet is drawn over the mandrel. According to the invention, during forward movement of the billet with the mandrel, the billet is offset relative to the mandrel in the same direction for a distance equal to that covered by the billet portion fed to the working rolls, the backward movement of the billet with the mandrel being effected at a speed substantially close to the peripheral speed of the working rolls at the starting moment of the drafting operation.

Such a method of pilger rolling of tubes makes it possible to prevent the working rolls from hitting the tube being rolled, to decrease the dynamic loads acting on the mill, to stabilize the billet feeding rate, and to ensure the production of high-quality tubes from various metals, including hard-to-deform metals and alloys, while simultaneously reducing the inside diameter of a tubular billet by 10–60% and its wall thickness by 10–90%.

The invention provides a pilger mill intended for carrying out the method of the invention and comprising a stationary roll mill stand with continuously rotating working rolls driven from a main drive, a billet feeding and turning mechanism, and a billet gripping jaw. The billet feeling and turning mechanism and the billet gripping jaw are kinematically linked with the main drive and with each other. The billet gripping jaw has screw nuts coaxially arranged therein and cooperating with a lead screw mounted together with a mandrel rod in a carriage. A mechanism adapted to transmit reciprocated motion to said carriage has its driving and driven cranks kinematically linked with the main drive and also kinematically linked with a tube turning mechanism having tube gripping means accommodated in its housing. According to the invention, feeding and turning shafts in the billet feeding and turning mechanism are made hollow and formed with openings, of a shape other than round in cross section, adapted to receive respectively the lead screw and the mandrel rod coaxially arranged therein, the lead screw and the mandrel rod conforming in profile to the cross section of the openings in said shafts to thereby enable their joint turning and axial displacement relative thereto. The axes of rotation of the driven and driving cranks in the mechanism for transmitting reciprocated motion to the carriage are offset relative to each other.

Such a constructional arrangement will enable the lead screw and the mandrel rod to simultaneously rotate about their axes and to move longitudinally relative to the billet feeding and turning mechanism.

In addition, the working rolls will be prevented from hitting the billet, the dynamic loads acting on the roll mill stand will be reduced, the billet feeding rate per minute will be increased and carried out in a uniform manner, and the operations of setting and resetting the rolling mill will be increased.

The tube gripping jaws of the tube turning mechanism are preferably arranged in the body thereof to thereby enable joint displacement of the jaws together with the tube along the axis of rolling.

Such a structural arrangement will make it possible to prevent spontaneous axial displacement of the unfinished tube at the moment of rolling the joint, thereby ensuring uniformity of the feeding operation.

BRIEF DESCRIPTION OF THE DRAWINGS

The invention will be further described in terms of its preferred double-strand embodiment with reference to the accompanying drawings, wherein.

DETAILED DESCRIPTION OF THE INVENTION

Figure 1:
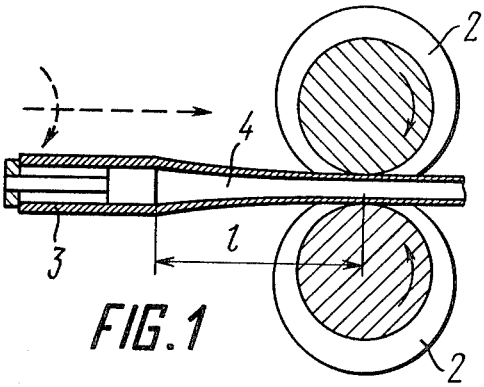
FIGS. 1 to 3 shows the relative arrangement of the working rolls, and the position of a tube over a mandrel during various stages of rolling effected in accordance with the pilger rolling method of the invention.
Figure 4:
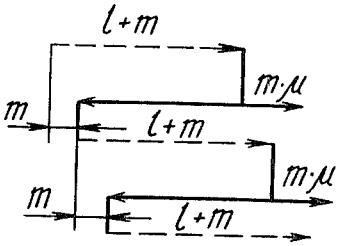
FIG. 4 schematically illustrates the movements of a billet in the course of rolling effected in accordance with the method of the invention.
Figure 2:
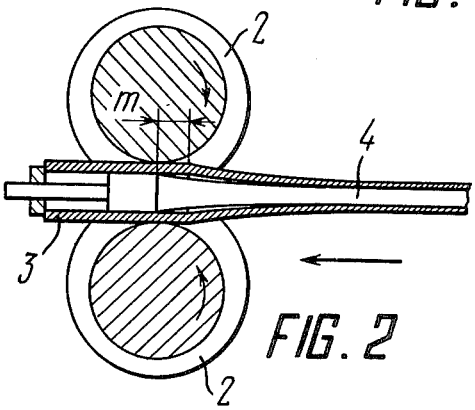

Referring now to the drawings in detail, the method according to the invention for pilger rolling of tubes effected in a stationary roll mill stand 1 with continuously rotating working rolls 2 is carried out in the following manner. A tubular billet 3 with a mandrel 4 is displaced forward in the direction of rolling a distance "l" corresponding to the length of the billet portion "m" which undergoes reduction performed by the working rolls 2. Simultaneously, the billet 3 with the mandrel 4 is turned about its longitudinal axis as the portion "m" of the billet 3 is advanced between the working rolls 2. As the billet 3 with the mandrel 4 is moved backward, the portion "m" of the billet 3 is drawn over the mandrel 4. During forward movement of the billet 3 with the mandrel 4, the billet 3 is displaced relative to the mandrel 4 in the same direction for a distance equal to that covered by the portion "m" of the billet 3 advanced between the rolls 2. The backward movement of the billet 3 with the mandrel 4 is effected at a speed substantially close to the peripheral speed of the working rolls 2 at the starting moment of the drafting operation. This makes it possible to prevent the working rolls 2 from hitting the billet 3.

In the course of drafting the wall of the billet 3 is reduced in thickness by 10 to 90 percent of the initial wall thickness, with the inside diameter thereof being reduced by 10 to 60 percent of the initial diameter. The billet 3 is drawn over a mandrel 4 of variable cross section.

The amount of reduction of the billet 3 depends upon the size of the pass formed by the working rolls 2 and upon the size of the mandrel 4. The cross-sectional dimensions of the roller pass and of the mandrel 4 at the beginning of the reduced portion "m" conform to the cross-sectional dimensions of the billet 3, and to the cross-sectional dimensions of the finished tube at the end of the working portion. Thus, the cross-sectional dimensions of the pass and of the mandrel 4 are altered from a maximum value at the beginning of the working section to a maximum value at the end of said section. The working rolls 2 are formed curvilinear in longitudinal profile, which curve is calculated from the cross-sectional dimensions of the billet 3 and from the dimensions of the finished tube taking into account the strain-hardening factor of the material of the billet 3.

The billet profile is calculated by the following formula:

$$D = \frac{D_o}{1 + K_1(x)\left(\frac{D_o - D_1}{D_1}\right)},$$

and the profile of the pass formed by the working rolls is calculated by $$R = \frac{D}{2} + \frac{t_o}{1 + K_2(x)\frac{t_o - t_1}{t_1}},$$

where $K_1$, $K_2$ are the work-hardening coefficients of the metal being rolled;

X is the distance from the beginning of the roller pass to the end of the prescribed cross section;

$D_o$ is the inside diameter of the billet 3;

R is the radius of the roller pass within a distance "x";

D is the diameter of the mandrel 4 within a distance "x";

$D_1$ is the inside diameter of the finished tube;

$t_o$ is the wall thickness of the billet; (3); and $t_1$ is the wall thickness of the finished tube.

After backward movement of the billet 3 with the mandrel 4 is completed, its forward movement is resumed; the rolling cycle continues until the finished tube is produced.

Figure 5:
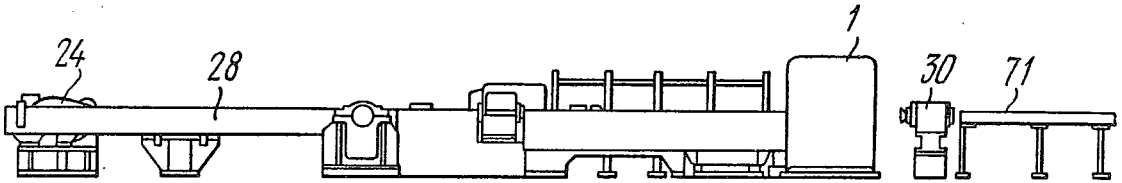
FIG. 5 is a side view of a pilger mill for rolling tubes according to the invention.
Figure 6:
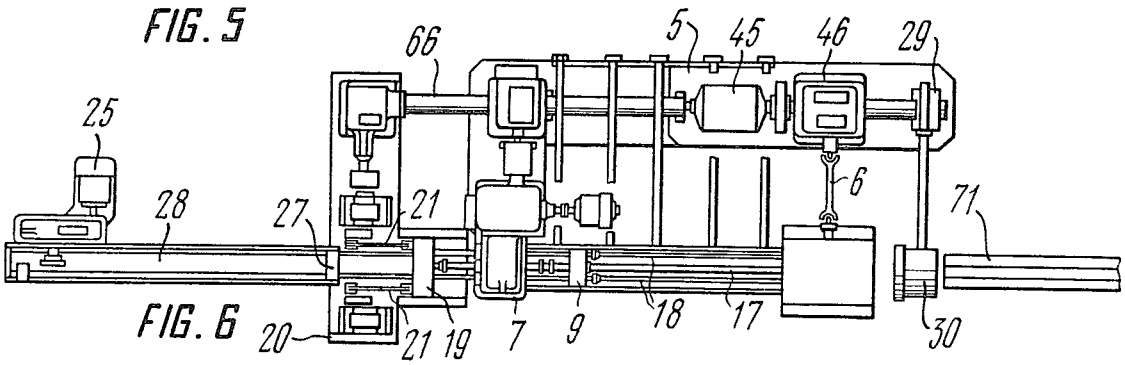
FIG. 6 is a top view of the mill shown in FIG. 5.
Figure 7:
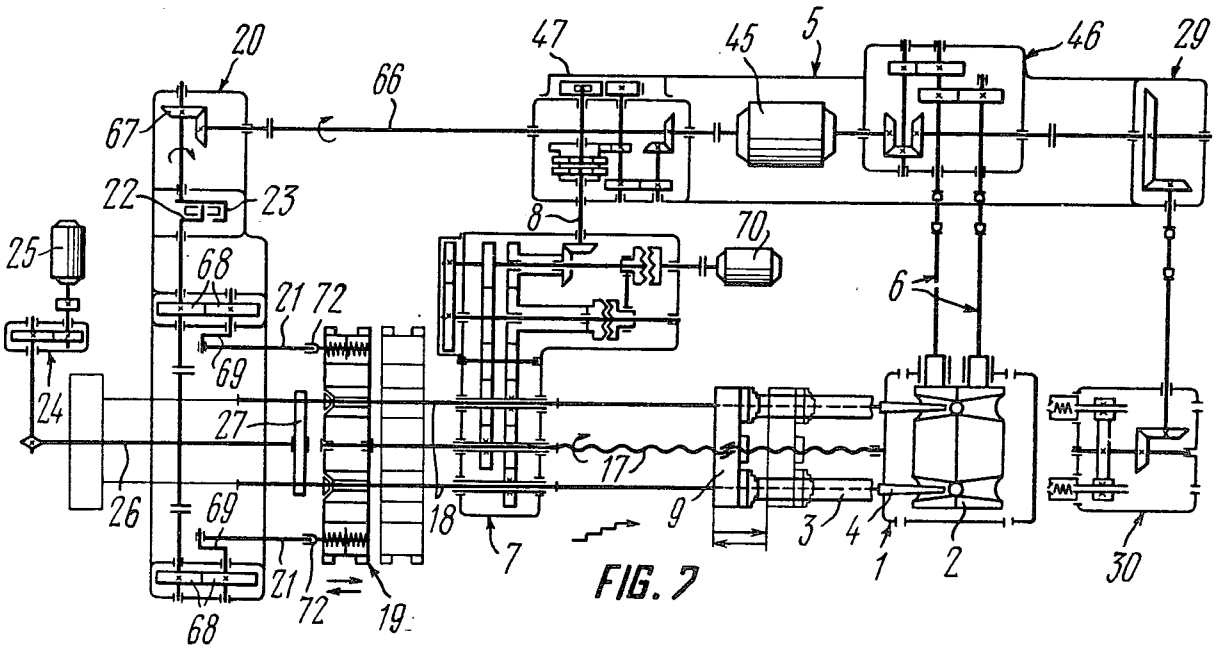
FIG. 7 is a diagram showing the connections of a pilger mill for rolling tubes, according to the invention.

The pilger mill according to the invention comprises a stationary roll mill stand 1 (FIGS. 5 to 7) with continuously rotating working rolls 2 driven from a main drive 5. The working rolls 2 are connected with the main drive 5 by means of spindles 6. The main drive 5 is kinematically linked with a mechanism 7 for feeding and turning a tubular billet 3 by a shaft 8. Also connected with the main drive 5 is a jaw 9 for gripping the billet 3, provided with coaxially arranged nuts 10 and 11 and a spring 12 interposed therebetween. The nut 10 is fixedly mounted within a housing 13 (FIG. 8) of the gripping jaw 9, whereas the nut 11 is mounted for axial movement within the play of threaded engagement under the action of the spring 12. The housing 13 also accommodates hollow spindles 14 provided with three-jaw chucks 15 and changeable sleeves 16. The nuts 10 and 11 of the jaw 9 (FIG. 8) for gripping the billet 3 cooperate with a lead screw 17 positioned together with mandrel rods 18 in a carriage 19. The changeable sleeves 16 (FIG. 8) interact with the mandrel rods 18 of the mandrels 4 (FIG. 7). A mechanism 20 adapted to transmit reciprocated motion to the carriage 19 is linked through connected rods 21 to said carriage and has its driven crank 22 and driving crank 23 kinematically linked with the main drive 5. The carriage 19 associates via the mandrel rods 18 and the lead screw 17 with the mechanism 7 for feeding and turning the billet 3. The mandrel rods 18 positioned in the carriage 19 are kinematically linked with a mechanism 24 intended for the withdrawal of the mandrel rods 18 and incorporating an actuator 25, a chain drive 26 and a slide carriage 27 mounted on guides of a frame 28. Geared to the main drive 5 by a reducer 29 is a tube turning mechanism 30.

The tube turning mechanism 30 comprises a stationary housing 31 (FIG. 11) with a former made as changeable segment members 32 rigidly fixed at the interior surface of the housing 31. Mounted within the housing 31 and driven from a spur gear 33 is a hollow spindle 34 with clamps made in the form of half-rings 35 and 36. The fixedly mounted half-ring 35 extends in the radial direction and the half-ring 36 cooperates via a pusher 37 with a spring 38 pressing against a gib 39.

The gib 39 is adapted to hold connecting rods 40 (FIG. 12) linked to a crossbar 41 which carries a roller 42. The roller 42 is brought in contact with changeable segment member 32. Fitted in the recess of the hollow spindle 34 along the axis of its rotation is a spring 43 (FIG. 11) which interacts via a sleeve 44 with the butt ends of the half-rings 35 and 36, which are thereby enabled to move within the housing 31 along the axis of rolling together with the rolled portion of the tubular billet.

The main drive 5 comprises an electric motor 45 connected to a reducer 46 and to a mechanism 47 for transmforming continuous motion into intermittent.

The reducer 46 and the transforming mechanism 47 are constructed in a conventional manner and, therefore, will not be herein described in detail.

According to the invention, the mechanism 7 for feeding and turning the billet 3 incorporates turning shafts 48 (FIG. 8) and a feeding shaft 49, the shafts being made hollow and having their central borings formed in a shape other than of a round cross section to thereby allow coaxial arrangement therein of the mandrel rods 18 and the lead screw 17, respectively.

The lead screw 17 and the mandrel rods 18 (FIG. 9) are profiles to conform in cross sectional shape to the shapes of the openings in the turning shaft 48 and are fixedly mounted in the carriage 19 for axial displacement relative to the shafts 48 and 49, and for joint rotation with said shafts. Fixedly attached to the shafts 48 and 49 are gears 51 and 50 (FIG. 8), which are connected through intermediate gears 52 and 53, as well as through change gears 54 and 55, to a driven shaft 57.

The driven shaft 57 is mounted together with the shafts 48 and 49, the intermediate gears 52 and 53, and the change gears 54 and 55 in a stationary housing 58.

The change gears 54 and 55 are respectively mounted on shafts 60 and 59 formed with splined ends having fitted thereon cog-wheel half-couplings 61 and 62 movable by means of a yoke 63. The half-coupling 61 cooperates with a shaft 64 and the half-coupling 62 cooperates with a half-coupling 65 mounted on the shaft 60.

The mechanism 20 (FIG. 7) adapted to transmit reciprocated motion to the carriage 19 incorporates bevel gears 67 connected to a shaft 66 and adapted to transmit rotation to the driving crank 23, the axis of rotation thereof being offset relative to the axis of rotation of the driven crank 22, whereby the rotation of a gear 68 is effected in a nonuniform manner through crankshafts 69 and through the connecting rods 21 geared to the carriage 19.

The pilger mill according to the invention operates in the following manner.

Prior to rolling, the mandrel rods 18 (FIG. 7) of the mandrels 4 are withdrawn from the stand 1 by means of the mandrel withdrawing mechanism 24. The gripping jaw 9 for clamping the billet 3 is also withdrawn from the stand 1.

The billet 3 to be rolled is fixed in position in the gripping jaw 9.

Thereupon, the mandrel rods 18 with the mandrels 4 are brought back to the stand 1 with the tail ends of the mandrel rods 18 being rigidly connected to the carriage 19.

Next, a cooling lubricant system (not shown) and the electric motor 45 of the main drive 5 are energized.

Continuous uniform rotation is transmitted from the motor 45 to the working rolls 2 mounted in the stand 1 by the reducer 46 and the spindles 6, and by the shaft 66 and gears 67 to the driving crank 23 of the mechanism 20 enabling reciprocation of the carriage 19.

The driven crank 22 functions to transform the continuous rotation of the driving crank 23 into intermittent rotation which is then transmitted through the gears 68 to the crankshaft 69.

The crankshafts 69 operate to transmit reciprocated motion by means of the connecting rods 21 to the carriage 19 mounted on guides (not shown).

The reciprocated motion of the carriage 19 with the mandrel rods 18 is transmitted through the lead screw 17 and the nuts 10 and 11 to the gripping jaw 9. The billets 3, gripped in the jaw 9, perform reciprocated motion together with the mandrels 4 along the axis of rolling. This reciprocation is coordinated with the rotation of the working rolls 2 so that the number of reciprocations performed by the billets 3 with the mandrels 4 is equal to the number of revolutions performed by the working rolls 2, since they are kinematically linked to the main drive 45.

As a result, it becomes possible to adjust the backward movement of the billet 3 so as to cause the billet 3 to move at a speed, while being engaged by the working rolls 2, substantially close to the peripheral speed of the working rolls 2, whereby the working rolls 2 are prevented from hitting the billet 3, the dynamic loads are lowered and the number of passes per minute is increased. Also, the degree of reduction of the billet 3 is increased due to nearly uniform strain of the metal occurring in the billet portion which undergoes deformation; the setting and resetting of the mill are carried out effectively and rapidly.

During forward movement of the billet 3 for a length "1", the billet is turned and again displaced forward a distance "m" covered by the billet portion under the action of the billet feeding and turning mechanism 7. As this happens, the billet 3 is offset relative to the mandrel 4.

Continuous rotation of the motor 45 is transformed into intermittent rotation by means of the transmitting mechanism 47. This intermittent rotation is transmitted through the shaft 8 to the billet feeding and turning mechanism 7 which functions to displace the billet 3 relative to the mandrel 4. The billet 3 is displaced for a feeding distance "m".

The mechanisms incorporated in the pilger mill of the invention function as follows.

The mechanism 7 intended for feeding and turning the billet 3 operates in the following manner. As the billet 3 undergoes deformation, the carriage 19 (FIG. 7) with the mandrel rods 18 and the lead screw 17 fixedly attached thereto, as well as the gripping jaw 9, are caused to travel as an integral unit under the action of the connecting rods 21 of the mechanism 20 enabling reciprocation of said carriage 19. The feeding and turning of the billet 3 are effected simultaneously.

Figure 3:
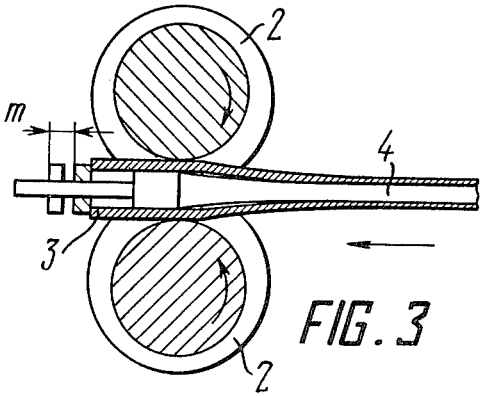

To displace the billet 3 relative to the mandrel 4 for a feeding distance "m" (FIG. 3) in the course of their forward movement, the feeding of the billet 3 is effected in the following manner.

As the carriage 19 travels forward, the driven shaft 57 (FIG. 7) is set into intermittent rotation by means of the main drive 5 (FIG. 6) through the transmitting mechanism 47 and through the bevel gears 56 (FIG. 8), the intermediate gears 53, the half-couplings 65 and 62, the shaft 60, the change gears 54 and 55, the shaft 59, the intermediate gears 52, the gear 50, and the hollow shaft 49 the lead screw 17 is caused to turn, thereby imparting additional motion through the nuts 10 and 11 to the billet gripping jaw 9 (FIG. 7) travelling in the rolling direction.

This displacement of the billets 3 relative to the mandrels 4 allows the use of a short-length mandrel 4 of variable cross section and makes it possible to reduce the billet in diameter to a value within the range of 10 to 60 percent of the initial diameter of the billet, and to simultaneously alternate the thickness of the billet wall to a value within the range of 10 to 90 percent of the initial thickness of the billet wall.

Figure 8:
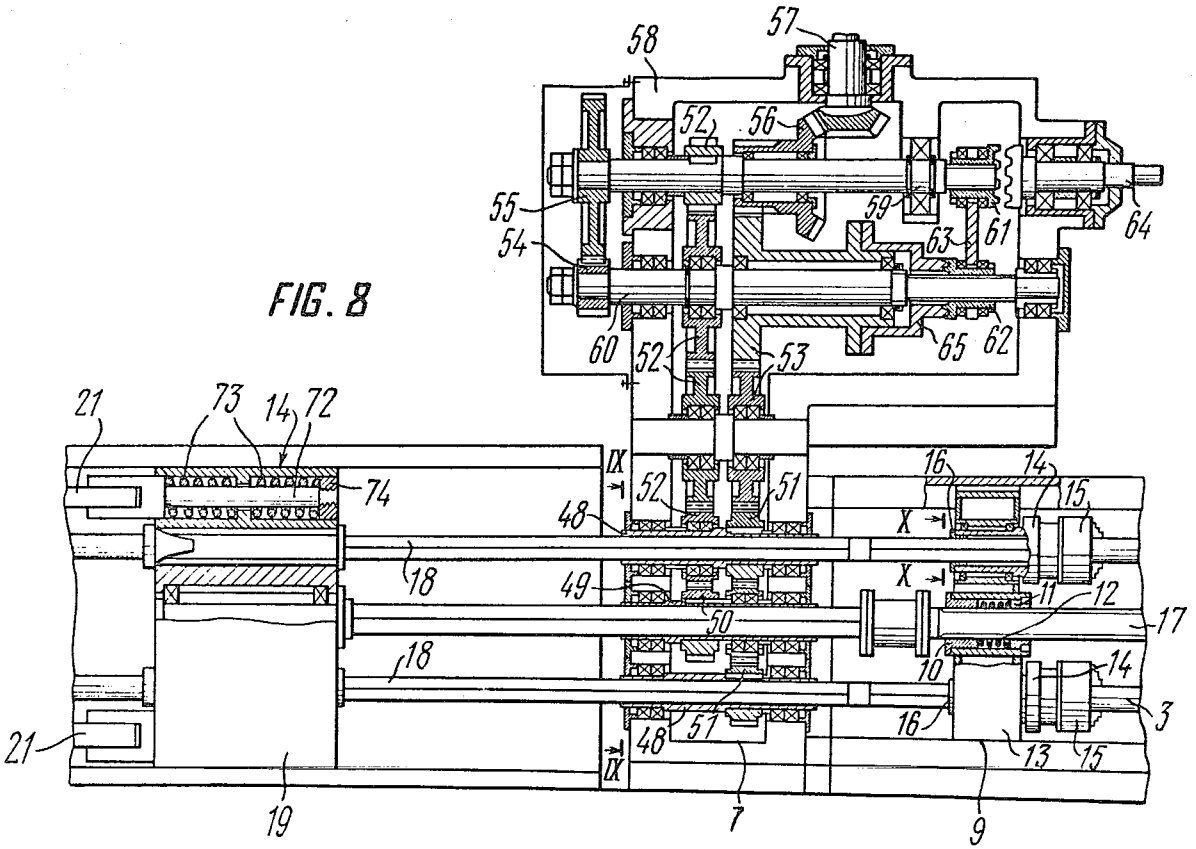
FIG. 8 is a cross-section of the pilger mill feeding mechanism taken in a horizontal plane extending through the axes of rotation of the mandrel rods and of the lead screw.
Figure 10:
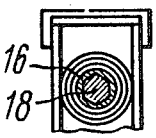
FIG. 10 is a cross-sectional view taken along the line X—X of FIG. 8.
Figure 9:
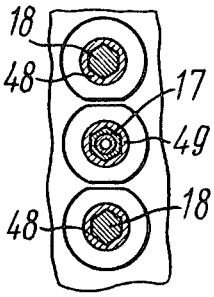
FIG. 9 is a cross-sectional view taken along the line IX—IX of FIG. 8.

The distance of feeding is set by an appropriate selection of the change gears 54 and 55 (FIG. 8). The nut 10 is rigidly fixed in the recess of the housing 13, the nut 11 being movable within the confines of the play which exists in the threaded engagement. This play is adjusted in the course of operation by means of the spring 12. Such a design of the threaded engagement makes it possible to eliminate the play in the thread of screw, reduce the dynamic loads in the nut-and-screw connection, permits uniform feeding of the billets 3 and enhances the operating reliability of this unit.

The tubular billets 3 are turned about their longitudinal axes by the driven shaft 57 (FIG. 8) through the bevel gears 56, the intermediate gears 53, the gears 51 and the hollow shafts 48 by the turning action of the mandrel rods 18. The mandrel rods 18 function to rotate the change sleeves 16 rigidly fixed in the interior of the hollow spindles 14 which carry the three-jaw clamping chucks 15 with the billets 3 gripped therein. The mandrel rods 18 of the mandrels 4 (FIG. 7) are facet-like in profile conforming in cross section to the openings of the change sleeves 16 (FIG. 8). This enables the billet 3 to be turned about its longitudinal axis without regard to the position of the gripping jaw 9 (FIG. 7).

As the billet 3 undergoes deformation, the half-coupling 62 (FIG. 8) is brought into engagement with the half-coupling 65.

When rapid continuous movement of the billet 3 is required, for example, during resetting of the mill, the half-coupling 61 is brought into engagement with the fast-moving shaft 64 by the yoke 63, and the half-coupling 62 is disengaged from the half-coupling 65, thereby discontinuing the kinematic linkage adapted to effect the turning movement.

During continuous movement of the billet 3, the motion energy of the electric motor 70 (FIG. 7) is transmitted through the shaft 64 (FIG. 8), the intermediate gears 52, the gears 50 and the hollow shaft 49 to the lead screw 17 which is operable to displace by means of the nuts 10 and 11 the billet gripping jaw 9 (FIG. 7) having the billets 3 fixed therein. The travelling direction of the gripping jaw 9 depends on the rotating direction of the electric motor 70 which is made reversible.

The tube turning mechanism 30 operates in the following manner.

The driving spur gear 33 (FIG. 11) geared to the main drive 5 (FIG. 7) enabling rotation of the working rolls 2 is operable to continuously rotate the hollow spindle 34 (FIG. 11) which carried the half-rings 35 and 36, the pusher 37, the spring 38, the gib 39, the connecting rods 40 (FIG. 12) and the crossbar 41 with the roller 42.

During the rolling operation the roller 42, interacting with the changeable segment members 32 through the crossbar 41, the connecting rods 40, the gib 39 and the pusher 37, causes the spring 38 to compress, thereby releasing the clamping half-rings 35 and 36, thus permitting unhindred passage of the rolled portion of the billet 3.

At the moment when the billet 3 is being fed and turned, the roller 42 passes through the section intermediate the segment members 32, thereby enabling the spring 38 to compress the half-rings 35 and 36 through the pusher 37 around the rolled portion of the billet 3, thus causing the billet 3 to turn. As this happens, the half-rings 35 and 36 are caused to move together with the tube in the interior of the hollow spindle 34.

The billet 3 undergoes rolling until the gripping jaw 9 (FIG. 7) approaches the stand 1. After the gripping jaw 9 has approached the stand 1, the feeding operation is discontinued with the half-couplings 62 and 65 (FIG. 8) being disengaged and the rolling mill is shut down. Thence, the billets 3 are released from the gripping jaw 9 and the gripping jaw 9 is withdrawn from the stand 1. The mandrel rods 18 with the mandrels 4 are likewise withdrawn, and the unrolled billets remain in the stand 1. Thereafter, new billets lubricated from inside are fixed in the gripping jaw 9, with the mandrels 4 being returned to the stand 1. Then, the mill is energized and the rolling is resumed. In the course of the feeding operation, the new billet 3 being fed pushes in the unrolled portion of the previous billet, which results in the head portion of the new billet 3 and the tail end of the previous billet being rolled simultaneously for some time.

Figure 11:
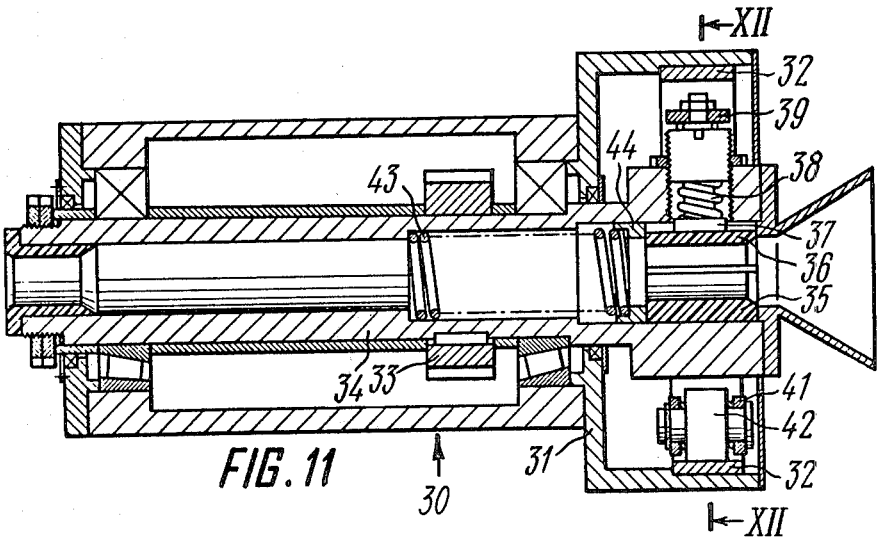
FIG. 11 is a longitudinal sectional view of the pilger mill tube turning mechanism.
Figure 12:
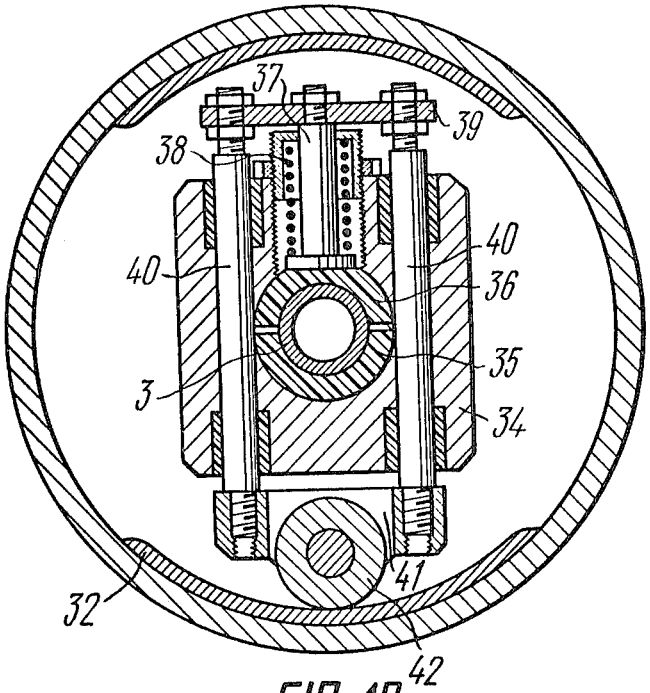
FIG. 12 is a cross-sectional view taken along the line XII—XII of FIG. 11.

Should a gap appear between the butt ends of the incoming billet and the unrolled portion of the outgoing billet during forward movement thereof, this gap will be eliminated by means of the spring 43 (FIG. 11). To make up for the difference in speed between the travelling speed of the carriage 19 (FIG. 7) and that of the tube moved by the working rolls 2 in the process of rolling, springs 73 are provided, which are mounted in the recesses of the carriage 19 on rods 72 (FIG. 8), with the compression force thereof being adjusted by means of nuts 74. When tension rolling is to be effected, only one spring is provided. Thus, the feeding of the billet 3 is carried out uniformly, which has a favorable effect on the billet deformation conditions, making it possible to perform rolling of the billet end portions so as to avoid their destruction, and to roll tubes to precise dimensions over the entire length thereof.

The outgoing billet is fed by means of the incoming one until the tube leaves the stand 1. Once out of the stand 1, the tube is removed from a trough 71 (FIGS. 5,6), mounted behind the tube turning mechanism 30, and is cut to lengths. This, however, does not exclude the cutting of the tube when still in the trough 71.

In order to carry out the rolling of tubes according to the method of the invention, the pass formed by the grooves in the working rolls 2 should be appropriately adjusted to a requisite oval shape.

Depending on the material and size of the billet 3, the feeding distance is varied within a range of from 0.85 to 8.5 mm. For example, when it is necessary to roll tubes from stainless steel, 20 by 0.5 mm in size, the feeding distance should preferably amount to 5 mm, whereas in the case of tubes of the same size from molybdenum, the feeding distance should be 2 mm.

The oval shape of the roller pass should preferably change over the groove length, depending on the radius "R" and the feeding distance "m".

The groove should be formed with a portion having a constant radius for the sizing of tubes.

The billets intended for rolling are usually produced by pressing, rolling or drafting. Billets produced by casting and mechanical treatment are likewise suitable for the purpose.

When rolling special-purpose tubes, it is necessary to control the quality and temperature of the lubricant.

The method and pilger mill of the invention are suitable for effecting maximum reduction of the billet in a single pass simultaneously over its inside diameter and across the tube wall, which makes it possible to substantially enhance the production efficiency of the mill used for rolling hard-to-deform metals and alloys, as compared to the prior-art pilger mills which perform rolling either with the aid of rollers or rolls according to the known methods.

With regard to the quality of the tubes rolled at the pilger mill according to the invention, it has been found to comply with manufacturing requirements as to the mechanical properties and metal structure.

A pilger roll was used to roll tubes from zirconium, stainless steel and other materials. The resultant tubes has the following dimensions: $13\times0.8$ mm; $10\times0.5$ mm; $10\times0.3$ mm; $7\times2.5$ mm; etc.

The tubes $10\times0.5$ mm were produced from a zirconium billet $22\times3$ mm in size. During examinations of these tubes, special attention was given to the structure of the metal and, more particularly, to the orientation of inclusions, viz. hydrides. The inside and outside surfaces of the tube walls had been found free from flaws. The dimensional accuracy of the tubes was found to be $\pm0.3$ percent in diameter and $\pm2$ percent in wall thickness.

The reduction of the tubes from stainless steel was 95 percent of the wall thickness thereof. The tubes showed high dimensional accuracy and good surface quality.

The structure and mechanical properties of the metal used for tubes depends upon the extent of their reduction. Numerous tests showed that the quality of tubes, as to the structure and mechanical properties of metal, as well as to their dimensional accuracy, met specific requirements provided the billet was reduced in diameter and in wall thickness by a value of not less than 10 percent, and reduced in inside diameter by a value of not more than 60 percent, and by a value of not more than 90 percent in wall thickness.

The tubes produced from the billet reduced by values in excess of those mentioned above had an unsatisfactory quality.

In the course of industrial testing special attention was paid to the tubes made from the materials prone to brittleness when subjected to excessive drafting. The pilger mill of the invention was found to be suitable for the production of tubes from the materials of the type mentioned above without any danger of destruction due to occur during excessive drafting of the billets. This testifies to the fact that the metal deforming conditions contribute to the creation of higher degree of the process plasticity.

Excessive drafting makes it possible to dispense with such intermediate operations as heat treatment, which becomes necessary if the tube rolling is effected with a lower degree of drafting in several passes.

The tubes of zirconium rolled according to the method of the invention had, owing to a high degree of drafting, good tangential orientation of hydrides, this being an important factor enhancing their durability when used in nuclear reactors and other similar installations.

Good results were obtained in the process of rolling thick-wall tubes which are reduced mainly in diameter. The tubes showed good surface quality.

The pilger mill according to the invention lends itself readily to automatic performance.

What is claimed is:

1. A method for pilger rolling of tubes in a stationary roll mill stand with continuously rotating working rolls forming a pass, the working section of which is curvilinear in profile, comprising the following steps:

moving a tubular billet with a mandrel forward in the rolling direction;

feeding a portion of the billet to the working rolls;

displacing the billet relative to the mandrel during said forward movement in the same direction for a distance covered by the billet portion fed to the working rolls;

turning the billet with the mandrel about its longitudinal axis;

moving the billet with the mandrel backward; and drawing the billet portion over the mandrel, said backward movement of the billet with the mandrel being effected at a speed substantially close to the peripheral speed of the working rolls at the starting moment of said drawing.

2. A pilger mill for performing the method according to claim 1, comprising:

a stationary roll mill stand;

continuously rotating working rolls mounted in said stationary roll mill stand;

a main drive effecting continuous rotation of said working rolls;

a billet feeding and turning mechanism geared to said main drive;

feeding and turning shafts of said billet feeding and turning mechanism made hollow and formed with openings having a cross section other than round;

a jaw for gripping the billet geared to said billet feeding and turning mechanism;

nuts coaxially positioned in said billet gripping jaw;

a lead screw connected with said nuts;

a carriage mounted for reciprocated motion;

a mandrel rod positioned together with said lead screw in said carriage, said lead screw and said mandrel rod being coaxially arranged in said feeding and turning shafts, respectively, and conforming in cross section to the openings in said feeding and turning shafts, respectively, to enable joint turning therewith and axial displacement thereto;

a mechanism imparting reciprocated motion to said carriage and geared to said billet feeding and turning mechanism and to said main drive;

a driven crank and a driving crank of said mechanism for reciprocating said carriage having axes of rotation offset relative to each other;

a tube turning mechanism geared to said main drive;

a housing of said tube turning mechanism; and tube gripping jaws arranged in said housing.

3. A pilger mill as claimed in claim 2, wherein said tube gripping jaws provided in said tube turning mechanism are mounted in said housing to permit joint displacement of said gripping jaws with the tube along the axis of rolling.

* * * * *